United States Patent [19]

Bragga

[11] Patent Number: 4,823,426

[45] Date of Patent: Apr. 25, 1989

[54] SHOE SOLE CLEANING DEVICE

[76] Inventor: Laurence G. Bragga, 144 S. Chestnut St., Jefferson, Ohio 44047

[21] Appl. No.: 158,881

[22] Filed: Feb. 22, 1988

[51] Int. Cl.[4] ..... A47L 23/00

[52] U.S. Cl. ..... 15/210 R; 15/227; 15/244.3; 2/DIG. 6; 2/170; 36/136

[58] Field of Search ..... 15/210 R, 161, 246, 15/244.3, 210 B, 209 R, 218.1, 227; 2/DIG. 6, 170; 36/136, 132

[56] References Cited

U.S. PATENT DOCUMENTS

| | | | |
|---|---|---|---|
| 2,575,361 | 11/1951 | Reip | 15/210 B |
| 2,827,651 | 3/1958 | Rizk | 15/210 R |
| 3,038,187 | 6/1962 | Nathanson | 15/209 B |
| 3,085,541 | 4/1963 | Leach | 36/83 |
| 3,699,672 | 10/1972 | Sims | 15/227 |
| 3,811,207 | 5/1974 | Peis | 36/117 |
| 4,061,256 | 12/1977 | Beer et al. | 2/170 |
| 4,120,052 | 10/1978 | Butler | 2/DIG. 6 |
| 4,287,633 | 9/1981 | Gnapper | 15/244.3 |
| 4,536,975 | 8/1985 | Harrell | 36/136 |
| 4,672,707 | 6/1987 | Johnson | 15/244.3 |

FOREIGN PATENT DOCUMENTS

| | | | |
|---|---|---|---|
| 84/03422 | 9/1984 | World Int. Prop. O. | 2/170 |

*Primary Examiner*—Harvey C. Hornsby
*Assistant Examiner*—Joseph S. Machuga
*Attorney, Agent, or Firm*—Body, Vickers & Daniels

[57] ABSTRACT

A cleaning device for dislodging, and picking up and retaining foreign particles and other matter adhered on athletic footwear soles or other discrete surfaces, comprising a pad assembly having an inner cushion pad element enclosed within a fabric outer cover, and attachment means on the device for removably clasping it around the fastened footwear laces or other support means to enable brisk rubbing of the footwear soles or other surfaces across the pad assembly of the device to remove foreign matter from such surfaces.

9 Claims, 2 Drawing Sheets

FIG. 1
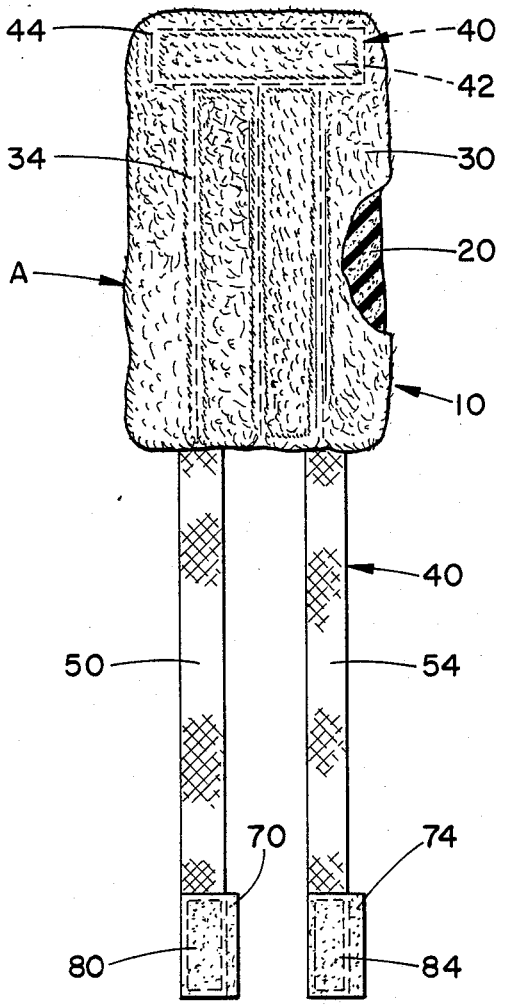
FIG. 2
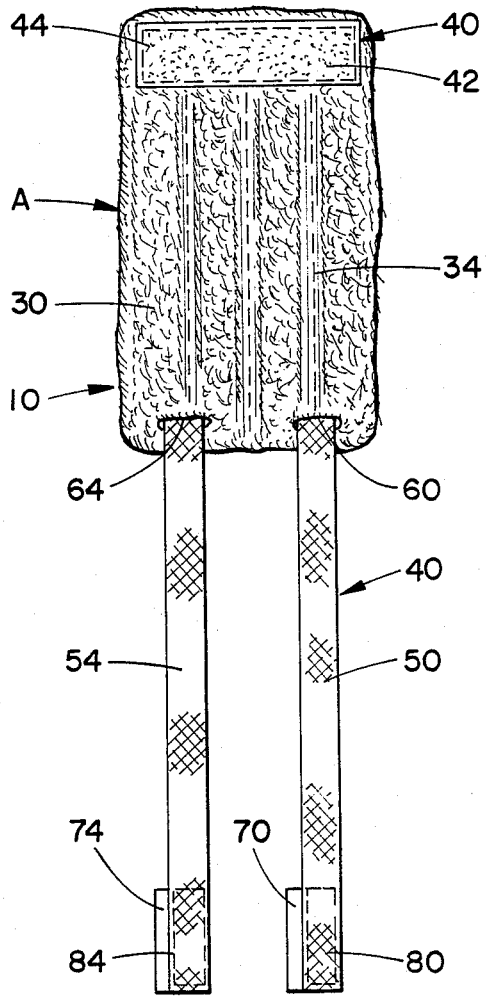
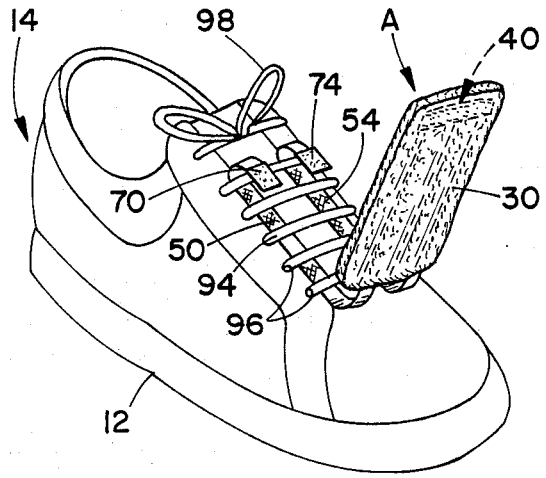
FIG. 3
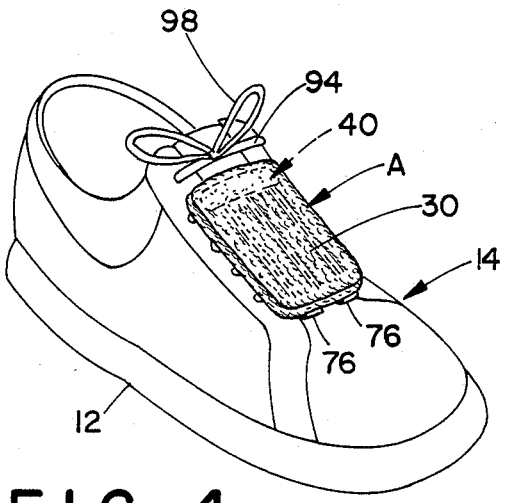
FIG. 4

SHOE SOLE CLEANING DEVICE

BACKGROUND OF THE INVENTION

This invention relates to a device for the removal or pick-up and retention of foreign particles from diverse particle-collecting surfaces.

In the field of athletics, in order for an athlete to effectively achieve his best performance levels, attention must be completely focused on what the athlete is trying to accomplish. Oftentimes, an athlete is unable to achieve his or her top performance level because of factors beyond his control such as, for example, an injury of one kind or another. There are other factors, however, which hamper the training routine and performance level of an athlete but which are readily controllable to thereby permit the athlete to achieve his top performance level. Examples of such performance detracting factors are moisture, dirt or dust particles collecting on a particular training or playing surface, or resulting from considerable training or performance activity thereon.

In the game of basketball, for instance, it is desirable that the players have the ability to safely utilize their best footwork abilities in order to thereby train effectively and achieve their top performance levels without subjecting themselves to the chance of injury. Various tread designs on the soles of sneakers or athletic footwear worn by athletes primarily allow a player to train or perform with the proper footwork necessary to accomplish his desired performance levels. However, the types of playing surfaces upon which an athlete trains or performs, such as wood, synthetic or linoleum, are also an important factor in determining whether an athlete will train or perform with the proper or his best footwork.

In the past, when moisture, dust or dirt particles have been present on these playing surfaces, an athlete's training or playing ability was then hampered because of the pick-up of these particles by, and their collection on the soles of the athlete's footwear, which then prevented them from obtaining the maximum traction necessary for them to achieve their highest level of footwork. One method commonly used theretofore to remove such foreign particles from the soles of the player's footwear involved the moistening of the player's hands with saliva or water and then manually rubbing the soles of the shoes with the moistened hands. However, this procedure ordinarily would lead to the athlete being unable to then use his hands for training or playing because of the resultant foreign particles present thereon. Another method heretofore often used by athletes to remove the foreign particles from the soles of his footwear has been to rub the soles of the footwear on the socks worn on the opposite leg of the player. However, this procedure has the drawback that, because it puts a strain upon the player's leg joints due to the player being in an unnatural or unbalanced position, this particular procedure might lead to the possibility of the player falling and sustaining injury.

Aside from the above two factors, it should also be kept in mind that the playing surfaces upon which an athlete trains or performs often are used for a variety of purposes other than merely athletic purposes. Thus, in various schools, the gymnasium also serves as the cafeteria and assembly room. When used in such a wide variety of ways, the floors of these multi-purpose rooms do not create the desired resultant friction and foot traction ordinarily produced with the particular athletic footwear worn by the athlete when free of moisture, dust and dirt particles that are often present on such floor surfaces and picked up on the players footwear. Furthermore, when an athlete is training or performing on a hard court playing surface, the resultant perspiration of the player most often ends up on the floor surface. As of the present, there are no devices available for quickly removing these foreign particles or substances that may be present on a playing surface when an athlete is training or performing thereon.

SUMMARY OF THE INVENTION

The present invention contemplates a novel contrivance which overcomes all of the above referred to problems and others and provides a device capable of dislodging, and picking up and retaining therein, foreign particles or substances present on and adhered to various discrete surfaces.

Briefly stated, in accordance with one aspect of the invention, there is provided a device comprised of a pad assembly including a pad element having a fabric outer surface for dislodging, and picking up and retaining therein foreign particles or substances present and adherent on a discrete surface such as the sole of athletic footwear, and attachment means on the pad assembly for removably securing it to suitable support means therefor so that it may be removed for cleansing or washing.

According to another aspect of the invention, the attachment means of the device may comprise at least one fastening strap fixedly secured at one end to the pad assembly of the device and removably securable at its other end to the pad assembly to form a closed tie loop therewith for fastening around a support means such as a person's wrist or the laced tie laces of a person's footwear. The attachment means may suitably comprise cooperating Velcro fastener means on the pad assembly and on the free end of the fastener strap or straps for securing the strap at its free end to the pad assembly.

The principal object of the present invention is to provide a cleaning device which is of relatively simple design and inexpensive construction and is capable of disloding, and picking up and retaining foreign particles and substances adherent on various discrete surfaces.

Another object of the invention is to provide a lightweight device of the above referred to character which is adapted to be conveniently worn by a person for instantaneous availability thereof for its intended purpose.

Still another object of the invention is to provide a device of the above referred to character which can be conveniently worn by persons participating in athletic contests played on hardcourt floor surfaces to enable them to readily and momentarily clean foreign particles off the soles of their footwear in order to restore and maintain the best possible traction on such floor surfaces.

A further object of the invention is to provide a cleaning device of the above referred to character which can be readily and removably secured to the laced tie laces of a person's hardcourt footwear to enable the quick removal of foreign particles from the footwear soles simply by forcefully brushing the soles of the footwear worn on each foot back and forth across the cleaning device on the footwear worn on the other foot.

BRIEF DESCRIPTION OF THE DRAWINGS

The foregoing objects, and others, will in part be obvious and in part pointed out more fully hereinafter in conjunction with the written description of a preferred embodiment of the invention illustrated in the accompanying drawings in which:

FIG. 1 is a plan view, partly broken away, of a cleaning device according to the invention capable of dislodging, and picking up and retaining foreign particles or substances adhered to various discrete surfaces;

FIG. 2 is a bottom view of the device shown in FIG. 1;

FIG. 3 is a perspective view of athletic footwear showing an initial step in attaching thereto the cleaning device comprising the invention;

FIG. 4 is a perspective view similar to FIG. 3 but showing the cleaning device fully secured in place on the footwear; and, FIG. 5 is a schematic view of a cleaning device according to the invention secured in place on a person's wrist.

DESCRIPTION OF THE PREFERRED EMBODIMENT

Figure 5:
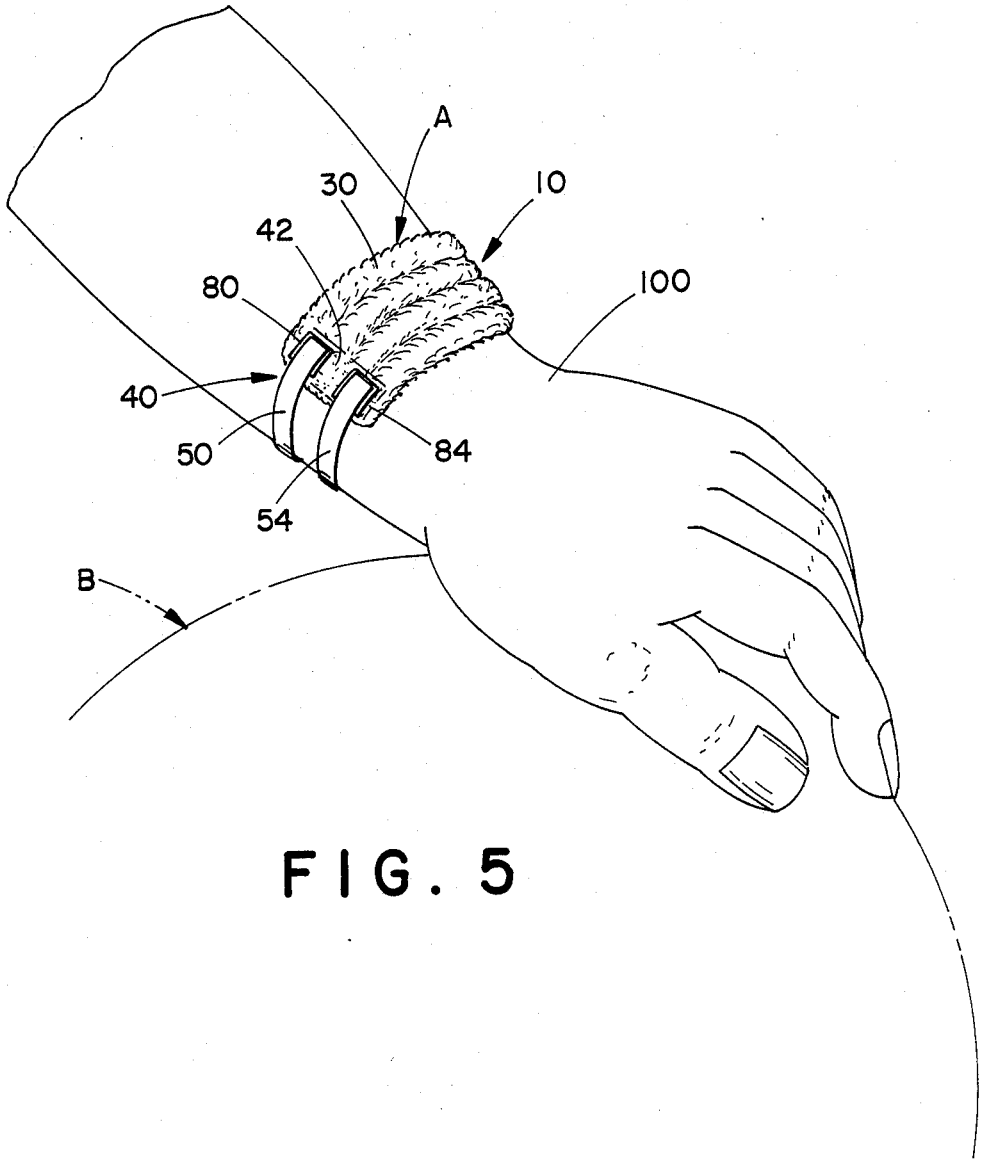

Referring now in greater detail to the drawings wherein the showings are for the purpose of illustrating a preferred embodiment of the invention only and not for the purpose of limiting the invention, the numeral 10 denotes generally a cleaning device according to the invention for dislodging, and picking up and retaining thereon, foreign particles and other substances adhered to various discrete surfaces (not shown) such as the soles 12 of athletic footwear 14 (FIGS. 3 and 4). Device 10 is comprised mainly of a pad assembly A having a generally flat rectangular shape overall, and construction thereof will be best understood by reference to FIG. 1.

The device 10 is comprised principally of an inner elongated cushion or rubber-like pad element 20 (FIG. 1) of sponge material, which element is shown as being of generally rectangular shape and enclosed within a fabric outer cover 30 which is suitably secured to the inner pad element 20 as by means of stitching 34 to form therewith the pad assembly A of the aforementioned generally rectangular shape. The fabric outer cover 30 is preferably formed of a suitable fabric material such as terry cloth, for instance, which is capable of readily retaining thereon the foreign material or other substances to be removed by the device 10 from the aforementioned various discrete surfaces.

Also attached to the pad element 20 and fabric outer cover 30 of pad assembly A is a fastening or attachment means 40 for removably securing the device 10 to a support means therefor such as the athletic footwear 14 or a person's wrist 16 (FIG. 5). The attachment means 40 comprises a Velcro-type fastener strip 42 extending across and secured to one end of the pad element 20 and fabric outer cover 30 of pad assembly A on one of the flat sides thereof by means of stitching 44. The attachment means 40 further comprises a pair of fastener strap means 50 and 54 which extend in spaced parallel relation endwise from, and are each fixedly secured at one end as by stitching 60, 64, to the end of the pad assembly A opposite the end thereof provided with the Velco fastener strip 42.

The free ends of the fastener straps 50, 54 opposite the ends thereof fixedly secured to the pad assembly A are provided with small Velcro fastener pads 70 and 74 for coacting interlocking engagement with the fastener strip 42 to removably secure the free ends of the fastener straps 50, 54 to the fastener strip 42 and pad assembly A and form tie loops 76 for removably securing the device 10 in place on a support means such as an athletic shoe 14 (FIG. 4). The fastener pads 70, 74 are fastened to the fastener straps 50 and 54 by means of stitching 80 and 84.

FIGS. 3 and 4 illustrate the manner of attaching the cleaning device 10 comprising the invention to athletic footwear 14 to enable the use of the device to remove and clean off foreign particles or other matter adhered to the soles 12 of the footwear, particularly while being worn. Thus, with the tie laces 94 of the footwear 14 threaded through the conventional eyelets 96 thereof but as yet not drawn tight and tied together, the free ends of the pair of fastener straps 50, 54 on each device 10 to be attached to a respective one of a pair of footwear shoes are first passed underneath the laced tie laces 94, preferably as shown in a direction upwardly from the bottom end of the laced tie laces so as to project from the upper end region thereof, following which the laced tie laces 94 are then drawn tight through the lace-receiving eyelets 96 (FIG. 3) of the footwear and their projecting free ends then tied together in a bow or other tie knot 98, as is customary. Thereupon, the pad assembly A of the cleaning device 10 is positioned to overlie and cover the laced tie laces 94 as shown in FIG. 4 and, while manually held in such position, the free ends of the pair of fastener straps 50, 54 projecting from the upper end of the laced tie laces 94 (FIG. 3) are drawn tight under the tightened and tied together laces 94, and the small Velcro fastener pads 70, 74 on the fastener straps 50, 54 then pressed into interlocking engagement with the Velcro fastener strip 42 on the pad assembly A to form the closed fastener strap tie loops 76 (FIG. 4) fastened tight around the tightened laced tie laces 94 to thereby removably secure and hold the cleaning device 10 in place on the footwear 14 on the so-called upper portion thereof, with the fabric cover 30 of the device 10 exposed at the top side of the footwear in position for ready use thereof for its intended cleaning purpose. The removal of foreign particles and other matter from the soles 12 of the footwear is then quickly and easily accomplished simply by briskly rubbing the sole 12 of the footwear 14 worn on each foot of the wearer back and forth across the fabric covered pad assembly A of the cleaning device 10 secured to the footwear 14 worn on the other foot of the wearer. The removal of the foreign particles or other material from the soles 12 of the athletic footwear 14 then restores the highest level of footwear traction obtainable therewith by the wearer on a hardcourt playing surface.

FIG. 5 illustrates the supporting of a cleaning device 10 according to the invention in a different manner from that shown in FIG. 4, for example, on the wrist 100 of a person engaged in energetic activity such as jogging, running, tennis, handball, racquetball, volleyball, lacrosse, football, and other sports activities such as those played with a basketball or bowling ball as indicated at B. The cleaning device 10 in this case may, as shown, be simply strapped tight around the person's wrist 100, much in the same manner as the device 10 in FIG. 4 is strapped tight around the tightly drawn laced tie laces 94 of the athletic footwear 14, and it may be used to either remove foreign particles or other material from the soles of the footwear 14 worn by persons wearing the cleaning device 10 on their wrist 100, or to remove other foreign substances from their person such as body perspiration from their brow or other body surface areas.

Because of the removable attachment of the device 10 according to the invention to the footwear 14 or other support means therefor by the releasable fastening means 40, the device 10 therefore may be easily removed from the footwear 14 whenever desired such as to permit the periodic cleaning of the fabric cover element 30 of the pad assembly A by washing or otherwise. The device 10 is removed from the footwear 14 or other support means simply by manually pulling apart and separating the Velcro pad elements 70, 74 on the fastening straps 50, 54 from the Velcro strip 42 on the pad assembly A.

From the above, it will be apparent that I have provided a novel type cleaning device 10 which is of simple and inexpensive construction and of light weight, and which is easily and quickly applied to a person's footwear or wrist to enable the instantaneous and quick use of the device, even during the progress of an athletic contest, to readily dislodge foreign particles or other matter from the soles of the footwear worn by such person in order to thereby restore the highest possible level of traction for the wearer of the footwear on the hardcourt-type playing surfaces.

Having thus described my invention, the following is claimed:

1. A sole cleaning device for a hardcourt athletic shoe having tie means extending transversely across the upper portion thereof, said device comprising a pad assembly including an inner cushion pad element and a fabric outer cover enclosing said pad element, said fabric outer cover being adapted to wipe clean a shoe sole of dust and dirt, and attachment means connected to said pad assembly, said attachment means comprising strap means adapted to extend in a releasably secured loop around said tie means to releasably attach said pad assembly to said upper portion of said shoe.

2. The device of claim 1 wherein said pad element is comprised of a sponge material.

3. The device of claim 1 wherein said fabric outer cover is comprised of terry cloth material.

4. The device of claim 1 wherein said strap means comprises a plurality of fastener straps each fixedly secured at one end to one end of said pad assembly, and extending endwise therefrom in spaced parallel relation and removably securable at their free other end to the other end of said pad assembly.

5. The device of claim 4 wherein said pad assembly is comprised of a sponge material.

6. The device of claim 4 wherein said fabric outer cover is comprised of terry cloth material.

7. The device of claim 4 wherein said attachment means includes coacting strap fastening means on said other end of said pad assembly and on said free ends of said fastener straps for removably securing said free ends of said fastener straps to said pad assembly.

8. The device of claim 7 wherein said coacting strap fastening means comprises pressure sensitive fastener elements on said pad assembly and on said free ends of said fastener straps.

9. The device of claim 4 wherein said fastener straps are formed of nylon material.

* * * * *